US007350966B2

(12) United States Patent
Zaugg

(10) Patent No.: US 7,350,966 B2
(45) Date of Patent: Apr. 1, 2008

(54) WATCH INCLUDING AT LEAST TWO REGULATING SYSTEMS

(75) Inventor: Alain Zaugg, Le Brassus (CH)

(73) Assignee: Montres Breguet SA, L'Abbaye (CH)

( * ) Notice: Subject to any disclaimer, the term of this patent is extended or adjusted under 35 U.S.C. 154(b) by 93 days.

(21) Appl. No.: 11/277,990

(22) Filed: Mar. 30, 2006

(65) Prior Publication Data

US 2006/0221775 A1 Oct. 5, 2006

(30) Foreign Application Priority Data

Mar. 30, 2005 (EP) ..... 05006849

(51) Int. Cl.
*G04F 5/00* (2006.01)

(52) U.S. Cl. ..... 368/140; 368/163; 368/127

(58) Field of Classification Search ..... 368/140, 368/163, 127, 124, 168
See application file for complete search history.

(56) References Cited

U.S. PATENT DOCUMENTS

| | | | | |
|---|---|---|---|---|
| 3,357,174 | A * | 12/1967 | Guyot | 368/208 |
| 4,363,553 | A * | 12/1982 | Thomi et al. | 368/140 |
| 5,699,322 | A * | 12/1997 | Born | 368/66 |
| 5,838,641 | A | 11/1998 | Tohkoku | |
| 7,004,619 | B2 * | 2/2006 | Papi | 368/127 |
| 7,016,265 | B2 * | 3/2006 | Born et al. | 368/163 |
| 2005/0036405 | A1 * | 2/2005 | Born et al. | 368/127 |
| 2005/0201209 | A1 | 9/2005 | Golay | |
| 2006/0007789 | A1 * | 1/2006 | Papi | 368/127 |

FOREIGN PATENT DOCUMENTS

| | | |
|---|---|---|
| CH | 30754/568 | 11/1905 |
| CH | 156801 | 11/1932 |
| CH | 256590 | 3/1949 |
| CH | 262017 | 9/1949 |
| CH | 693 832 A5 | 2/2004 |
| CH | 695 196 A5 | 1/2006 |
| EP | 0 846 987 A1 | 6/1998 |
| EP | 1 465 024 A1 | 10/2004 |

(Continued)

OTHER PUBLICATIONS

Search Report issued in corresponding Australian Patent Application No. SG 200601948-3, completed Jul. 12, 2006 and mailed Jul. 20, 2006.

European Search Report completed Feb. 10, 2006 in corresponding application No. EP 05 00 6849.

*Primary Examiner*—Gary F. Paumen
(74) *Attorney, Agent, or Firm*—Griffin & Szipl, P.C.

(57) ABSTRACT

The invention concerns a watch with a mechanical movement of the type comprising at least two regulating systems (SR1, SR2) each including a mechanical oscillator and an escapement. The movement includes as many sub-assemblies (SE1, SE2) as there are regulating systems, each of said sub-assemblies including a regulating system (SR1, SR2), a barrel (B1, B2) and a going train transmitting energy from the barrel to the regulating system inside the sub-assembly. A differential display gear (Da) connects the barrel or the going train of each sub-assembly to the display (A) to average out the rate of the two sub-assemblies. In a preferred embodiment, the two sub-assemblies are mounted on a common rotating support (5) and their regulating systems are tourbillons which make an orbital movement about the center of the watch dial.

9 Claims, 7 Drawing Sheets

FOREIGN PATENT DOCUMENTS

| | | | |
|---|---|---|---|
| FR | 2 784 203 | A1 | 4/2000 |
| GB | 2 027 232 | A | 2/1980 |
| GB | 2 375 619 | A | 11/2002 |
| WO | 03/017009 | A2 | 2/2003 |
| WO | 2004/077171 | A2 | 9/2004 |
| WO | 2004/097533 | A2 | 11/2004 |
| WO | 2005/043257 | A1 | 3/2005 |

* cited by examiner

WATCH INCLUDING AT LEAST TWO REGULATING SYSTEMS

This application claims priority from European Patent Application No. 05006849.3 filed Mar. 30, 2005, the entire disclosure of which is incorporated herein by reference.

BACKGROUND OF THE INVENTION

The present invention concerns mechanical clockwork movements, in particular in watches, and it concerns certain arrangements for reducing the errors in isochronism caused by imperfections in the regulating system of the watch.

The tourbillon invented two centuries ago by Abraham-Louis Breguet is a device that reduces errors in isochronism resulting from effects produced particularly by gravity on the regulating organs of the watch, because of the inevitable faulty poising of such organs. As the oscillator and the escapement are mounted in a carriage or cage which rotates about an axis parallel to the axis of the sprung balance assembly, the gravity component that is exerted in the perpendicular plane to these axes performs a continuous rotation in relation to the organs, such that each rotation of the cage leads to compensation for the effects of unbalance in that plane and thus improves the working regularity of the watch when worn, especially when the watch is in a vertical position. In order to simplify the terminology, the term "tourbillon" is used here to mean both devices in which the axis of the balance coincides with the rotational axis of the cage (for example according to Breguet or according to CH Patent No. 262 017) and devices often called "carrousels", where those axes are distinct (see for example CH Patent Nos. 30 754 and 256 590 and EP Patent No. 846 987).

Given that a conventional tourbillon only compensates imperfectly for the effects of gravity, watchmakers seeking to further improve the isochronism of high quality mechanical watches have designed tourbillons with two or three axes of rotation that are all perpendicular to each other, disclosed in particular in the Patent Publication Nos. GB 2 027 232, CH 693 832, EP 1 465 024 and WO 2004/077171. These constructions constitute a remarkable feat, but they occupy a spherical space and thus can only be fitted to an extremely thick watch.

According to WO 03/017009, a similar object is achieved by means of a tourbillon with two axes of rotation which intersect each other at an angle other than 90 degrees, for example 30 degrees. This construction is more compact as regards height than a construction with two perpendicular axes, but it remains considerably thicker than a conventional tourbillon movement.

FR Patent No. 2 784 203 presents yet another method of reinforcing the compensation provided by the tourbillon. The tourbillon, the barrel that drives it and the gear train connecting these two elements are mounted on a rotating plate completing one revolution per hour, whose axis of rotation is parallel to that of the tourbillon. This arrangement in a way forms a tourbillon on a carrousel, with the tourbillon revolving about the centre of the rotating plate.

Another method of improving isochronism was formulated in the 1930s by M. Vuilleumier and was published in CH Patent No. 156 801, consisting in using two normal regulating systems each comprising a sprung balance and an escapement in a single clockwork movement, these two systems being coupled to the going train by means of a differential gear fulfilling the duel function of distributing the drive energy in equal parts to the two systems and averaging the working thereof to regulate the speed of the going train. This principle did not meet with success, probably because the theoretical gains were offset by losses in efficiency in the additional gear trains, in particular in the differential gear. However, with the current tourbillon fashion, various watchmakers have returned to this principle to create watches comprising two or more tourbillons coupled by a differential gear. Such arrangements confer a prestigious aspect on the watches, but it remains to be seen whether they really improve isochronism compared to a watch with a single tourbillon.

SUMMARY OF THE INVENTION

The present invention concerns a mechanical movement comprising at lest two regulating systems each including a mechanical oscillator and an escapement, the regulating systems being mounted on a common support and connected to a common time display device via a differential gear, and its object is to improve this arrangement in a way that improves the working of a watch. An additional object is to create a watch having an original appearance showing the highly technical nature of its movement to the best advantage.

In its most general aspect, a watch according to the invention is characterized in that its movement comprises as many sub-assemblies as regulating systems, each of said sub-assemblies comprising a regulating system, a barrel and a going train transmitting the energy from the barrel to the regulating system within the sub-assembly, and in that the differential gear, called the display gear, connects the barrel or going train of each of said sub-assemblies to the display.

Thus, unlike the movements using the principle illustrated by CH Patent No. 156 801, the differential gear is not used for distributing the mechanical energy stored in the barrel springs to the regulating systems, but only to move the display members forward at the mean speed of the regulating systems. This gear train thus transmits almost no stress and does not affect the efficiency of going trains at all.

Preferably, the barrels are connected to each other and to a winding device by a differential winding gear. This has the advantage not only of allowing the two barrels to be wound together, but also compensates for the winding between them, which tends to equalise the oscillation amplitude of the balances between the regulating systems.

The common support of the regulating systems can be fixed in the watch, but in improved versions, it can be formed by a rotating plate, which adds compensation for the effects of gravity on unbalance as in a tourbillon. In order to obtain a particular appearance for the watch, the rotating plate could complete only two revolutions per day and carry an hour hand.

According to a preferred embodiment of the invention, the regulating systems mounted on the rotating plate are two tourbillon systems, which adds the compensatory effects provided by FR Patent No. 2 784 203 to the basic effects of the invention, in order to further improve the regularity of working of the watch. This principle is applied in the examples described hereinafter.

BRIEF DESCRIPTION OF THE DRAWINGS

Other features and advantages of the present invention will appear from the following description, which presents a preferred embodiment by way of non-limiting example with reference to the annexed drawings, in which.

DETAILED DESCRIPTION OF A PREFERRED EMBODIMENT

In order to explain more clearly how the example described hereinafter works, the block diagrams of FIGS. 1 and 2 respectively show a watch movement according to CH Patent No. 156 801 and a preferred embodiment of the invention. Reference will be made to the following legend:

| | |
|---|---|
| A | Display |
| B, B1, B2 | Barrel spring |
| Df | Going train differential |
| Dr | Winding train differential |
| Da | Differential display gear |
| F, F1, F2 | Going train |
| MH | Time-setting |
| SR1, SR2 | Regulating system |
| R | Winding |

In these diagrams, the single arrows represent gear trains with no energy transmission to the regulating systems, whereas the double arrows represent gear trains with energy transmission to the regulating systems. It will also be noted that, in these diagrams, the symbol SR can represent both an ordinary mechanical regulating system and a rotating regulating system, particularly a tourbillon.

Figure 1:
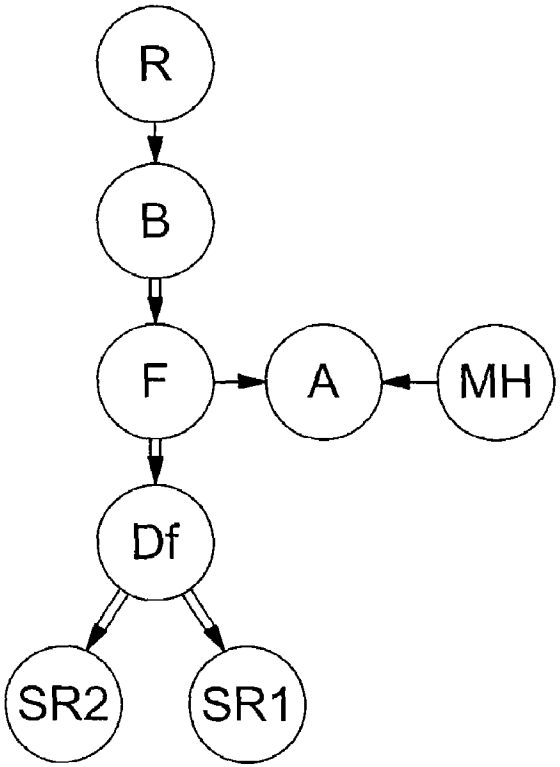
FIG. 1 is a block diagram of a mechanical watch movement with two regulating systems, of the type disclosed in CH Patent No. 156 801.

In the diagram of FIG. 1, the top part comprising the elements R, B, F, A and MH is the same as for a conventional clockwork movement. But, in this case, the single regulating system is replaced by an assembly comprising two regulating systems SR1 and SR2 and a going train differential Df which distributes the motor torque over the latter and, at the same time, regulates the speed of the gear train on the basis of the mean speed of the two regulating systems.

Figure 2:
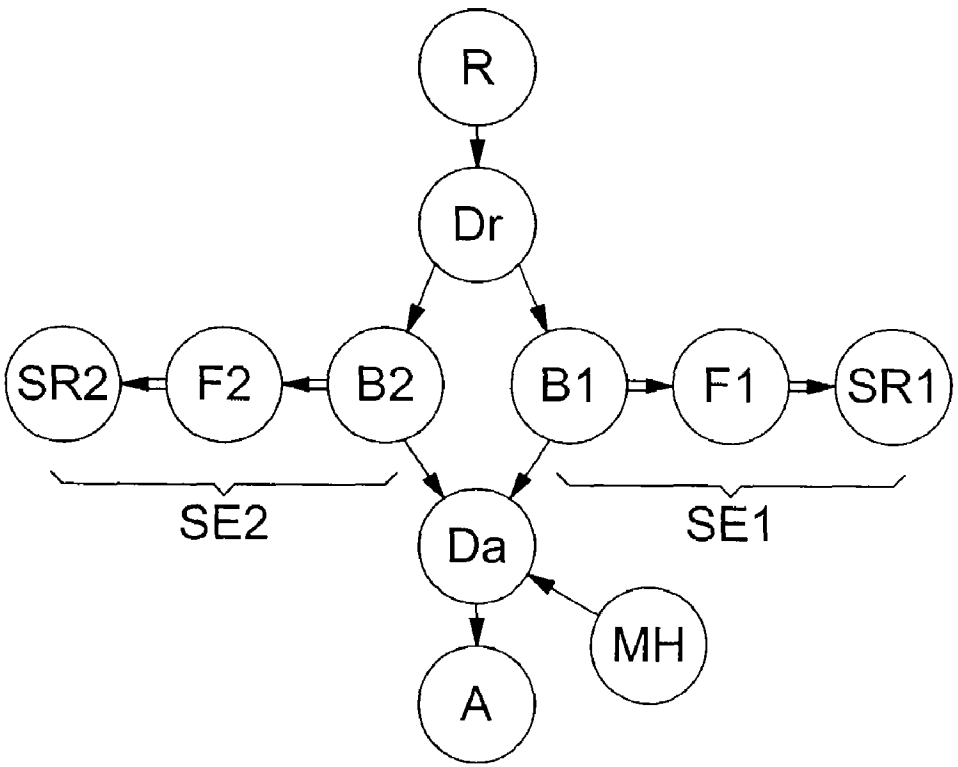
FIG. 2 is a block diagram of a mechanical watch movement according to preferred embodiment of the invention.

According to the embodiment of the invention which is illustrated by FIG. 2, each regulating system SR1, SR2 is paired with a barrel B1, B2 which drives it via an appropriate gear train F1, F2, i.e. each pair B1-SR1 and B2-SR2 forms a sub-assembly SE1, SE2 which can have its own rate, as if it were an independent watch movement. The design of these two sub-assemblies can be identical. In this example, the two barrels are permanently connected by a differential winding gear Dr whose input element is locked by a click during normal working of the watch. As a result the winding torques are permanently balanced via differential Dr, which helps to equalise the rate of these two regulating systems, in particular the oscillation amplitude of the balances.

The respective rotational speeds of the two barrels B1 and B2 are transmitted by two appropriate gear trains to two input elements of the differential display gear Da, which makes the mean thereof across its output element coupled to display A. Unlike the case of FIG. 1, this arrangement has the advantage of not transmitting the energy to the tourbillons via the gears which connect the barrels to the display, in particular via differential display gear Da. This also enables these gear trains to be lighter.

In the example described hereinbelow, the movement made in accordance with the diagram of FIG. 2 also includes the following peculiarities, helping to increase isochronism in different positions of the watch. On the one hand, the two regulating systems SR1 and SR2 are tourbillons. On the other hand, the two sub-assemblies SE1 and SE2 are mounted on a rotating plate, a large part of which is visible on the top face of the watch. The watch thus has an attractive and original appearance, presenting, on the dial side, two tourbillons, which perform an orbital movement around the centre of the watch while each rotating on themselves.

Figure 3:
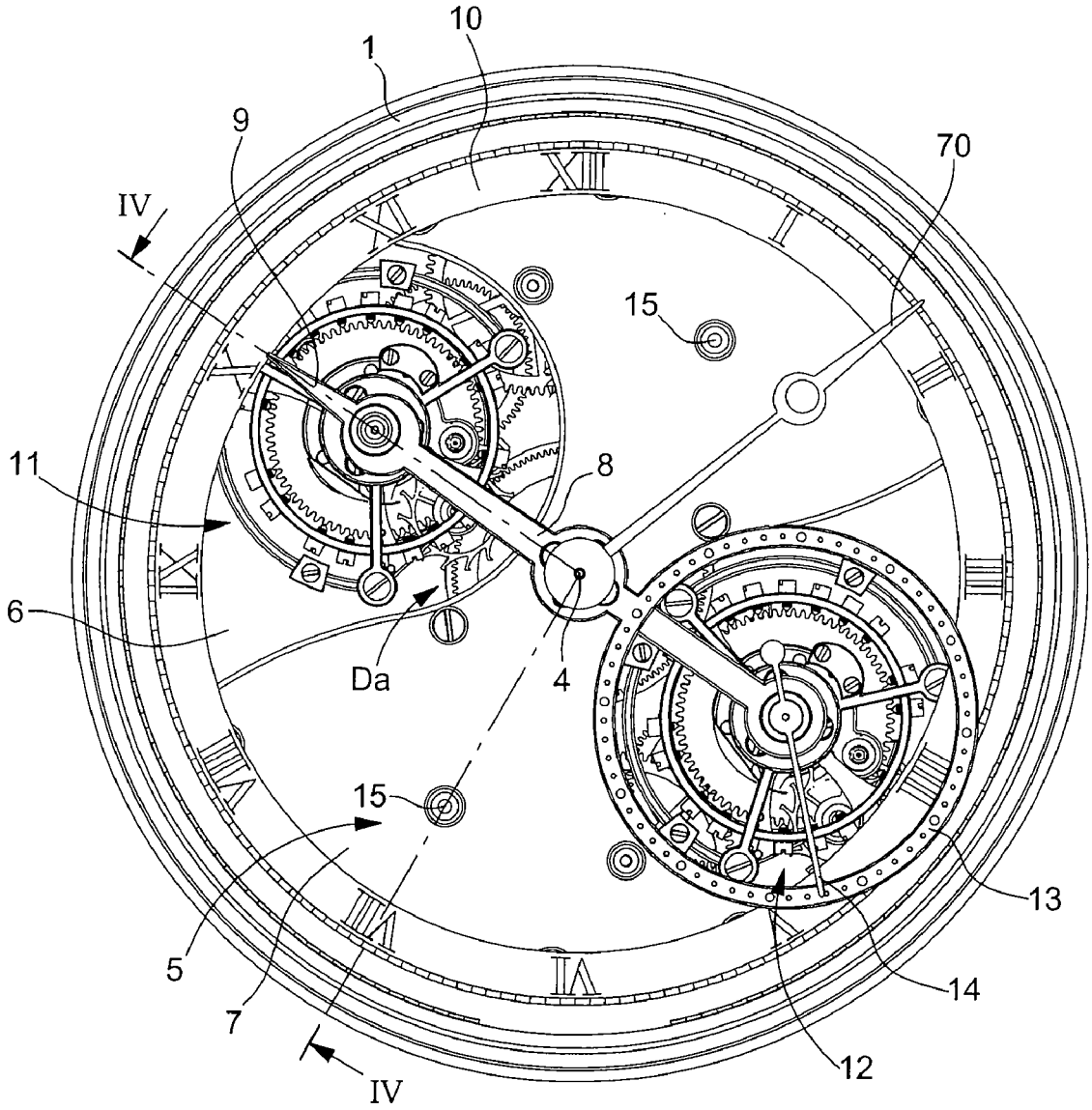
FIG. 3 is a schematic plan view of the movement and dial of a watch made in accordance with the diagram of FIG. 2, with two tourbillons on a rotating plate.
Figure 4:
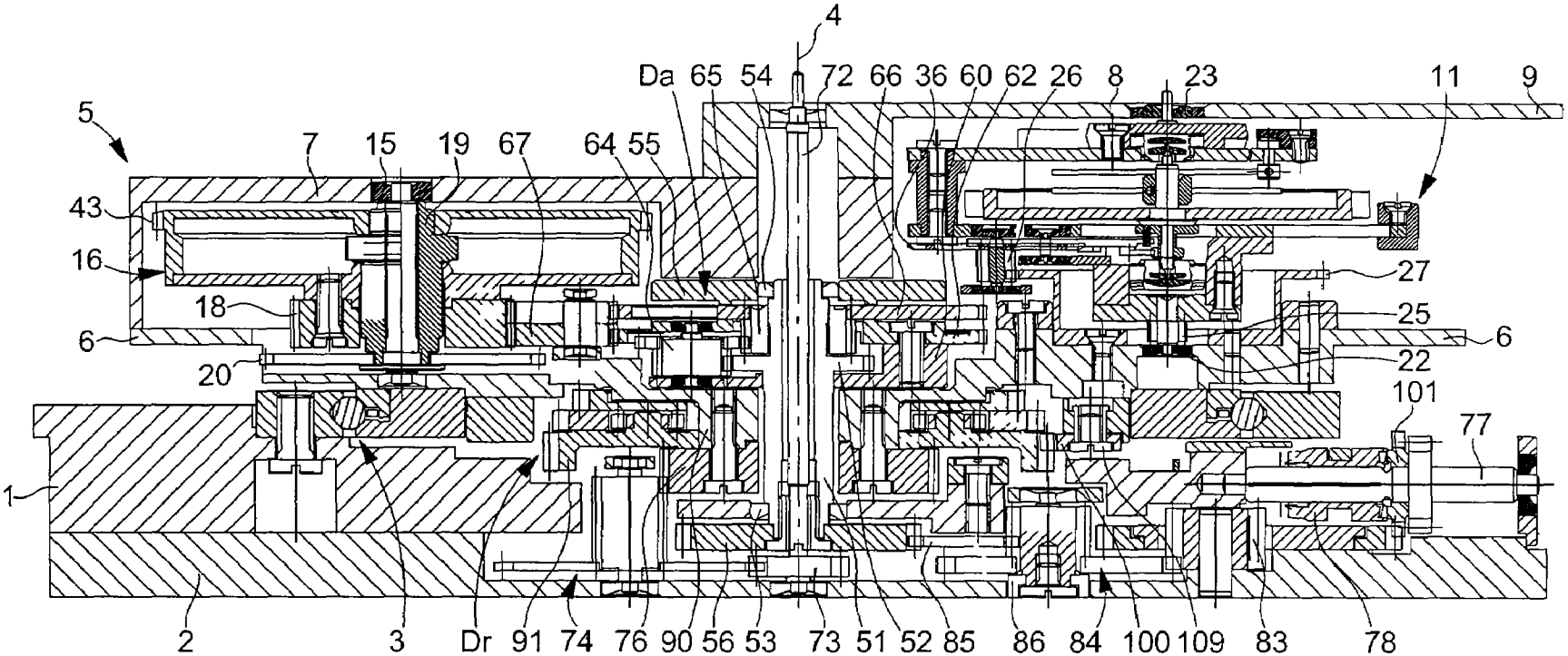
FIG. 4 is a cross-section of the movement along the line IV-IV of FIG. 3.

FIGS. 3 and 4 illustrate the general structure of the movement of the watch. The movement comprises a fixed plate 1 that is mounted in the watchcase and carries a time-setting bar 2 on its inner face. The outer ring of a large ball bearing 3 centred on an axis 4 is fixed to the top face of plate 1. The inner ring of this ball bearing carries a rotating support 5 including a rotating plate 6 to which there is fixed a main bar 7 and various other bars for carrying the gear trains. A top bar 8 is fixed to bar 7, the pointed end 9 of bar 8 forming the hour hand of the watch, moving opposite an hour index located on annular dial 10. Bar 8 further carries the top bearings of the two tourbillons 11 and 12, which are diametrically opposite in relation to the axis of rotation 4 of rotating support 5. Above tourbillon 12, bar 8 is provided with an annular part 13 carrying a second scale opposite a second hand 14 fixed to the top pivot of tourbillon 12.

The two barrels are mounted on rotating support 5 so that each barrel drives one of tourbillons 11 and 12. In FIG. 3, the barrels are hidden under bar 7, but bearings 15 which carry them in the bar show their plane position. One of the two barrels 16 is visible in FIG. 4, where it can be seen that one wheel 18 is fixed to the barrel, whereas the arbour 19 of the barrel is provided with a ratchet 20.

The drawing of FIG. 4 shows that the structure of tourbillon 11 is entirely conventional in this case, therefore it will not be described in detail. It will simply be noted that the bottom and top pivots of the tourbillon carriage are mounted by respective bearings 22 and 23 on rotating plate 6 and top bar 8. The second pinion 25 fixed to the tourbillon carriage is on the top face of rotating plate 6. The escapement pinion 26 of the tourbillon meshes on the fixed second wheel 27 secured to plate 6. The second tourbillon 12 is constructed in the same way and is at the same level as the first tourbillon.

Figure 5:
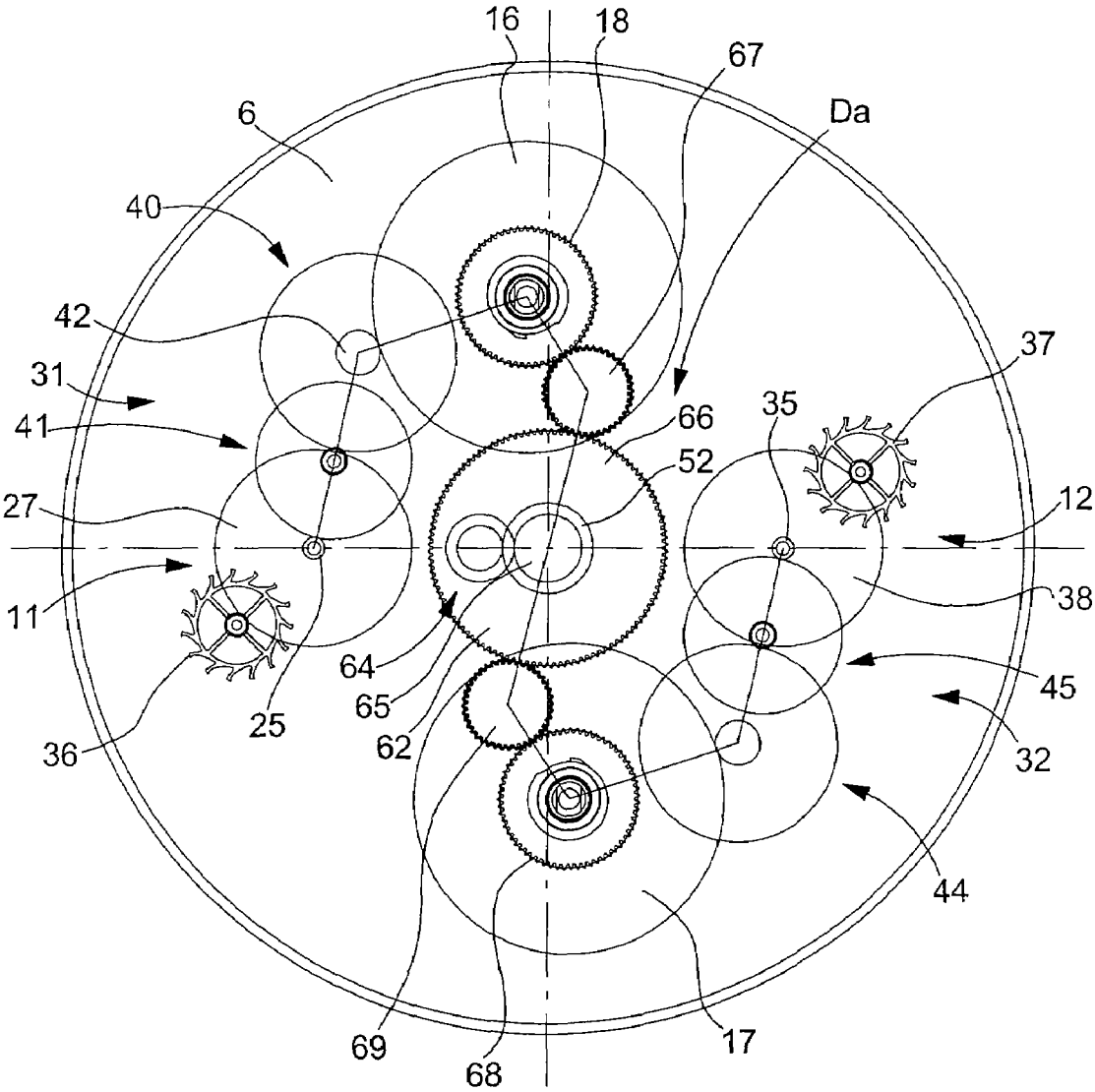
FIG. 5 is a plan view of the gear trains located above the rotating plate of the watch of FIGS. 3 and 4.

FIG. 5 shows that the two going trains 31 and 32 connecting each barrel 16, 17 to the corresponding tourbillon 11, 12, which is represented here only by the second pinion 25, 26 and the escape wheel 36, 37, whose pinion cooperates with the fixed second wheel 27, 28. Going train 31 includes a centre wheel set 40 and a third wheel set 41. Pinion 42 of the centre wheel set 41 is meshed with the peripheral toothing 43 of barrel 16. The wheel of centre wheel set 41 is meshed with the second wheel 25 of tourbillon 11, which it rotates via the action of the barrel. The other going train 32 is of identical construction, with a centre wheel set 44 and a third wheel set 45.

FIGS. 4 and 5 also show the gear trains connecting each barrel 16,17 to the display members via differential display gear Da that appears in FIG. 2. This is an epicycloidal gear, one of the three main elements of which is formed by a pipe wheel 51 provided with a toothed wheel 52. Pipe wheel 51 forms the support element for the differential gear and does not usually rotate, but to allow time-setting it is rotatably mounted by means of a bottom bearing 53 in plate 1 and a top bearing 54 in a bar 55 of the rotating part. A time-setting wheel 56 is fixed to the bottom end of pipe wheel 51 and cooperates with a time-setting train which will be described hereinafter and one of whose elements is immobilised by a friction device.

The second main element of the differential display gear Da is a planetary wheel carrier 60 formed of two parts one of which is an entry wheel with an outer toothing. In this case, a single planetary wheel 64 is provided, with two toothings, one of which meshes with wheel 52 of pipe wheel 51 and the other meshes with a pinion 65 secured to another entry wheel 66 of the differential. The two wheels 62 and 66 have the same diameter and play a symmetrical role, so that only half of them has been shown in FIG. 5. Wheel 66 is meshed with wheel 18 of barrel 16 via an intermediate wheel 67. Likewise, wheel 62 of the differential is meshed with a wheel 68 of barrel 17 via an intermediate wheel 9. If several planetary wheels were provided instead of a single one in this differential gear, the torque transmission would not be any better, since it occurs mostly over only one of them because of the inherent play in clockwork gears.

The toothings of planetary wheel 64 and the corresponding toothings of elements 52 and 65 are such that entry wheels 62 and 66 of he differential gear can rotate at equal and opposite speeds when pipe wheel 51 is immobile. But as these two speeds are each regulated by one of tourbillons 11 and 12 and can thus differ slightly because of momentary variations of rate, the effect of differential Da is to average out these two speeds in speed of revolution of support 5 carrying the tourbillon and gear train bearings that have just been described. Thus a better regularity of rate (isochronism) is thus obtained than that of each of the tourbillons.

The minute hand 70 shown in FIG. 3 is carried by an arbour 72 passing inside pipe wheel 51 and provided with a minute pinion 73 below plate 1. A conventional motion work wheel 74 connects pinion 73 to an hour wheel 76 fixed under rotating plate 6. Thus, it is support 5 carrying hour hand 9 which drives minute hand 70 with a transmission ratio of 12:1.

Figure 6:
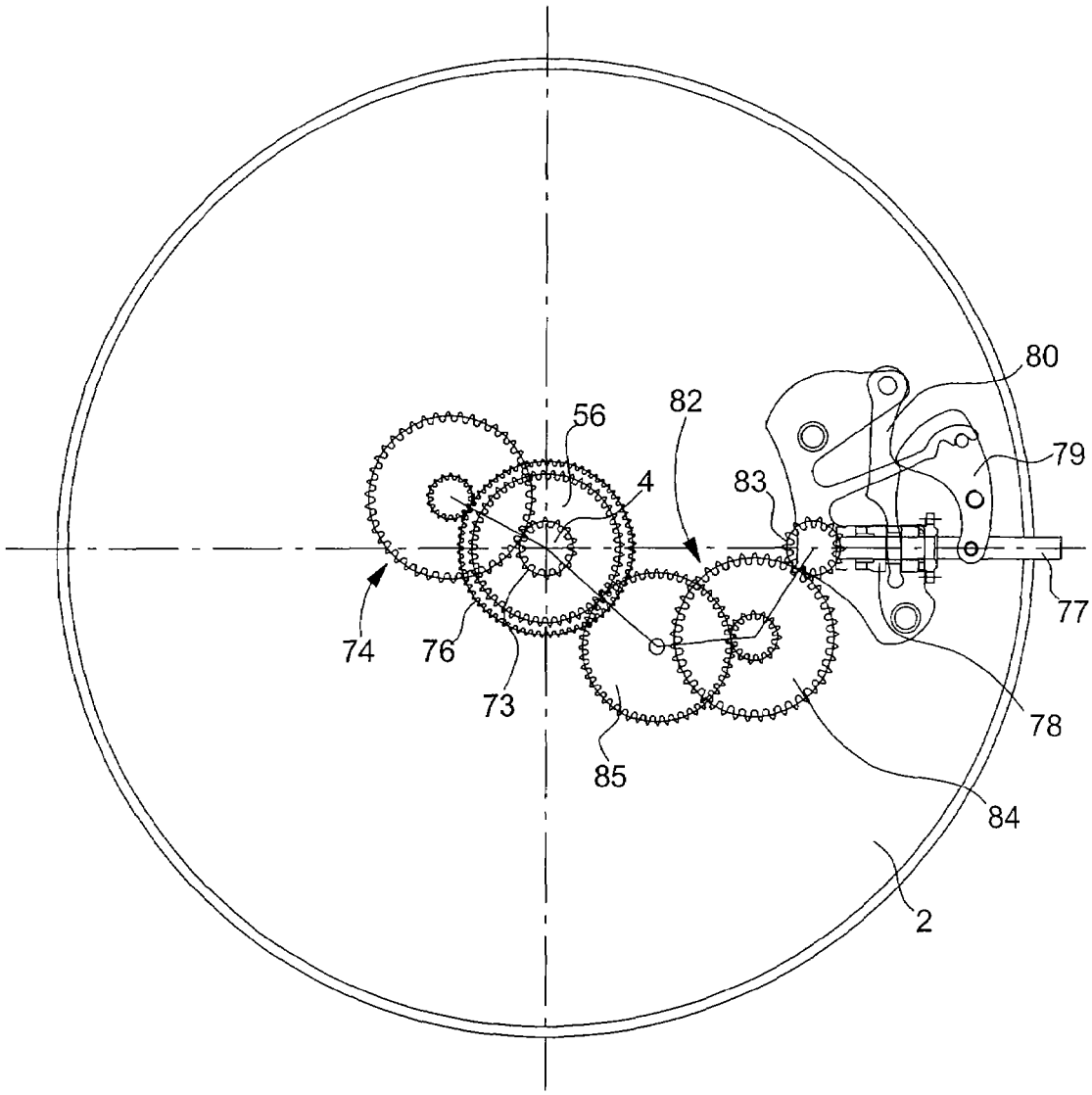
FIG. 6 is a plan view of the time-setting gear train of the watch of FIGS. 3 and 4, and FIGS. 7 and 8 are plan and partial cross-sectional views of the winding gear train of the watch of FIGS. 3 and 4.

The time-setting mechanism will be described with reference to FIGS. 4 and 6. Unusually, it does not act on the motion work wheel, but on wheel 56 secured to pipe wheel 51 which acts as a point of abutment for differential display gear Da, is thus used to define the angular position of rotating plate 6. Time-setting is accomplished via a winding stem 77 which carries a sliding pinion 78 controlled in a conventional manner by means of a pull-out piece 79 and a lever 80. When it is in the time-setting position, sliding pinion 78 meshes with a time-setting train 82 which connects it to wheel 56. This train includes a first pinion 83, an intermediate wheel set 84 and an intermediate wheel 85. The bottom end of wheel set 84 is mounted in bar 2 by means of a friction ring 86 which opposes a retaining torque against any rotation of the wheel set. It is this torque which, multiplied by the transmission ratio between wheel set 84 and pipe wheel 51, supplies a high enough support torque to prevent any rotation of pipe wheel 51 while the watch is working. However, the friction torque offers little resistance to the rotation of stem 77, due to the reduction that exists between these two elements.

As can be seen in FIG. 2, the winding mechanism for the two barrels uses a differential winding gear Dr. This differential gear and the winding gear train will be described with reference to FIGS. 4, 7 and 8.

The central part of rotating plate 6 has a cylindrical protruding part 90 towards the bottom that acts as a hub for the three main elements of the differential winding gear Dr, namely a planetary wheel carrier 91 and two exit wheels 92 and 93. This differential gear is of the planetary type, its two satellite wheels 94 meshing on an inner toothing of wheel 92 and on a toothing of central hub 89 of wheel 93. Wheel 92 drives ratchet 20 of barrel 16 via a gear train mounted on plate 6, comprising a wheel set 95 and an intermediate wheel 96. Likewise, wheel 93 drives ratchet 97 of the second barrel 17 via the insertion of a gear train including a wheel set 98 and an intermediate wheel 99. Of course, the diameters of the gear elements of differential Dr and the gear trains that follow are determined such that the torque applied to planetary wheel carrier 91 during winding is distributed equally over the ratchets of the two barrels.

Planetary wheel carrier 91 can only rotate in one direction, since it is blocked in the other direction by a click 100 (FIG. 4) which pivots about a screw 109 mounted in a fixed position in relation to rotating plate 6. Since the arbours of the two barrels are blocked at the input of differential gear Dr instead of acting as is usual directly on the ratchet of each barrel, the differential gear enables one of the barrels to transmit energy to the other if the latter is let down more than the first, for example if the tourbillon which is associated therewith has been operating at a slightly higher frequency than the other tourbillon. This results in an equalising of the winding of the two barrels at all times, which contributes towards equalising the oscillation amplitude of the balances in the two tourbillons.

Figure 7:
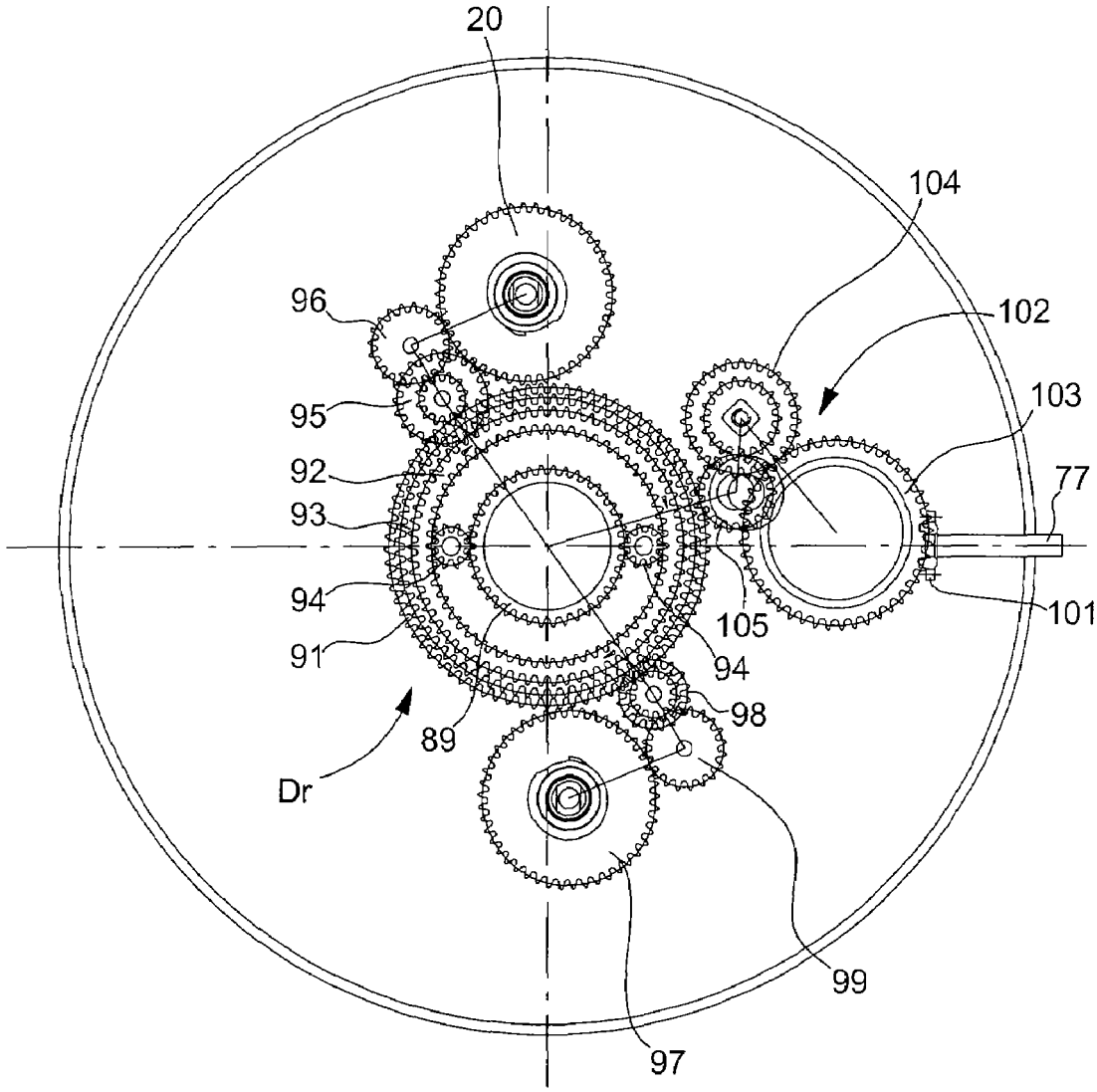
Figure 8:
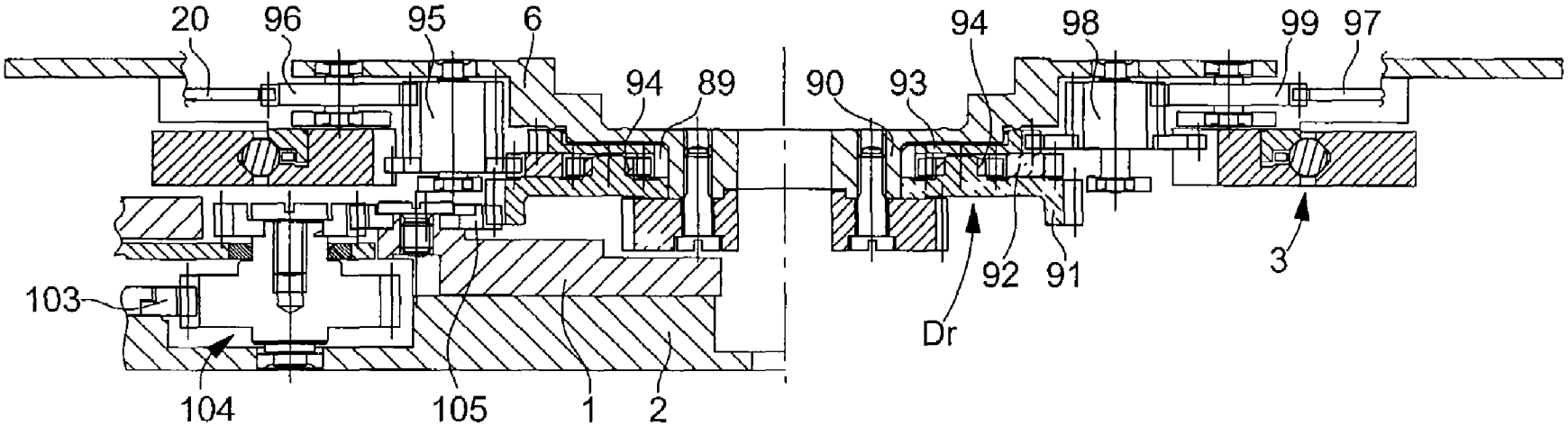

FIG. 4 shows a winding pinion 101, which can be driven by sliding pinion 78 when winding stem 77 is rotated. FIGS. 7 and 8 show that pinion 101 drives planetary wheel carrier 91 via a winding gear train 102, which includes a crown 103, an intermediate wheel set 104 and a sliding pinion 105 that will mesh on the outer toothing of planetary wheel carrier 91 when the gear train rotates in the winding direction.

Those skilled in the art will easily understand that the diagram of FIG. 2 can be achieved equally well on a fixed plate and on a rotating support, and that in each case each regulating system SR1 or SR2 can be either fixed, or rotating like a tourbillon, and it can also be a tourbillon with several axes of rotation, in particular of one of the types mentioned in the introduction. Those skilled in the art will also be able to devise a movement with more than two regulating systems by applying the principles of the present invention, since a suitable differential gear will allow more than two sub-assemblies like B1-SR1 and B2-SR2 to be coupled to average their speed on the watch display.

Moreover, even though the two regulating systems SR1 and SR2 have the same nominal frequency in the example described hereinbefore, this is not critical, since suitable sizing of the gear trains and the differential display gear enables two different nominal frequencies to be averaged properly.

What is claimed is:

1. A watch with a mechanical movement including at least two regulating systems each including a mechanical oscillator and an escapement, the regulating systems being mounted on a common support and connected to a common time display device via a differential gear, wherein the movement includes as many sub-assemblies as there are regulating systems, each of said sub-assemblies including a regulating system, a barrel and a going train transmitting energy from the barrel to the regulating system inside the sub-assembly, and wherein the differential gear, called the differential display gear, connects the barrel or the going train of each of said sub-assemblies to the display.

2. The watch according to claim 1, wherein the barrels are connected to each other and to a winding device by a differential winding gear.

3. The watch according to claim 1, wherein said common support is fixed in the watch.

4. The watch according to claim 1, wherein said common support is able to rotate.

5. The watch according to claim 4, wherein said rotating support completes two revolutions per day and carries an hour hand.

6. The watch according to claim 1, wherein the regulating system of each of said sub-assemblies includes a tourbillon.

7. The watch according to claim 4, wherein the regulating system of each of said sub-assemblies includes a tourbillon, and including two of said sub-assemblies, whose tourbillons are diametrically opposite in relation to the axis of rotation of the rotating support.

8. The watch according to claim 1, including a time-setting gear train connecting a winding stem to a support element of the differential display gear and wherein a friction blocking member exerts a retaining torque on said gear train that is multiplied by said gear train to retain said support element.

9. The watch according to claim 6, including two of said sub-assemblies, whose tourbillons are diametrically opposite in relation to the axis of rotation of the rotating support.

* * * * *